US012760430B2

(12) United States Patent
Mohri et al.

(10) Patent No.: US 12,760,430 B2
(45) Date of Patent: Oct. 13, 2026

(54) ELECTROLYTIC CELL

(71) Applicant: HONDA MOTOR CO., LTD., Tokyo (JP)

(72) Inventors: Masahiro Mohri, Wako (JP); Kazuki Yanagisawa, Wako (JP); Misato Maki, Wako (JP); Hideaki Yoneda, Wako (JP); Jumpei Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 653 days.

(21) Appl. No.: 18/210,384

(22) Filed: Jun. 15, 2023

(65) Prior Publication Data

US 2023/0416925 A1 Dec. 28, 2023

(30) Foreign Application Priority Data

Jun. 22, 2022 (JP) ..... 2022-100189

(51) Int. Cl.

| | |
|---|---|
| ***C25B 1/02*** | (2006.01) |
| ***C25B 1/23*** | (2021.01) |
| ***C25B 9/21*** | (2021.01) |
| ***C25B 9/23*** | (2021.01) |
| ***C25B 9/60*** | (2021.01) |
| ***C25B 11/02*** | (2021.01) |
| ***C25B 11/031*** | (2021.01) |
| ***C25B 15/08*** | (2006.01) |

(52) U.S. Cl.

CPC ..... *C25B 11/031* (2021.01); *C25B 1/02* (2013.01); *C25B 1/23* (2021.01); *C25B 9/23* (2021.01); *C25B 9/60* (2021.01); *C25B 11/02* (2013.01); *C25B 15/08* (2013.01)

(58) Field of Classification Search

None

See application file for complete search history.

(56) References Cited

U.S. PATENT DOCUMENTS

| | | | | |
|---|---|---|---|---|
| 4,885,142 | A * | 12/1989 | Suitor | B01D 53/326 204/266 |
| 2020/0131649 | A1* | 4/2020 | Krause | C25B 9/00 |
| 2020/0216968 | A1* | 7/2020 | Hunegnaw | C25B 11/091 |
| 2021/0292926 | A1 | 9/2021 | Ono et al. | |
| 2022/0166041 | A1 | 5/2022 | Mitsuta | |
| 2022/0290318 | A1* | 9/2022 | Oikawa | C25B 3/03 |

FOREIGN PATENT DOCUMENTS

| | | | |
|---|---|---|---|
| CN | 107732257 | A | 2/2018 |
| JP | 2018-037284 | A | 3/2018 |
| JP | 2021-147680 | A | 9/2021 |
| JP | 2022-083098 | A | 6/2022 |

OTHER PUBLICATIONS

Office Action dated Feb. 13, 2024 issued in the corresponding Japanese Patent Application No. 2022-100189 with the English machine translation thereof.

* cited by examiner

*Primary Examiner* — Harry D Wilkins, III

(74) *Attorney, Agent, or Firm* — Carrier, Shende & Associates P.C.; Fulchand P. Shende; Joseph P. Carrier

(57) ABSTRACT

An electrolytic cell includes a membrane electrode assembly, a pair of separators, a gas supply flow path, and a gas discharge flow path. A fuel electrode of the membrane electrode assembly contains a catalytic material that activates the electrolytic reactions of the raw material gas, and the amount of the catalytic material contained in the fuel electrode increases from the upstream side to the downstream side of the gas supply flow path.

7 Claims, 13 Drawing Sheets

ELECTROLYTIC CELL

CROSS-REFERENCE TO RELATED APPLICATIONS

This application is based upon and claims the benefit of priority from Japanese Patent Application No. 2022-100189 filed on Jun. 22, 2022, the contents of which are incorporated herein by reference.

BACKGROUND OF THE INVENTION

Field of the Invention

The present invention relates to an electrolytic cell.

Description of the Related Art

Conventionally, efforts have been continuously made for the purpose of mitigating or reducing the impact of climate change, and research and development on an electrolytic cell have been carried out for this purpose. The electrolytic cell electrolyzes a raw material gas such as carbon dioxide gas.

JP 2021-147680 A discloses an electrolytic cell including an anode, a cathode and a membrane. The membrane is disposed between and separates the anode and the cathode. The cathode has a cathode catalyst layer to be disposed on the membrane side and a gas diffusion layer to be disposed on the $CO_2$ gas flow field. At the cathode, the $CO_2$ gas introduced into the $CO_2$ gas flow field is electrolyzed.

In JP 2021-147680 A, the electrolysis performance of the electrolytic cell is determined in order to suppress a decrease in the cell output of the electrolytic cell caused, for example, by uneven distribution of the residual gas in the cathode.

SUMMARY OF THE INVENTION

However, in general, the residual gas in the cathode tends to decrease from the inlet to the outlet of the $CO_2$ gas flow field. That is, the electrolytic reaction sites are concentrated in a portion of the cathode corresponding to the upstream side of the $CO_2$ gas flow field. Therefore, there may be a problem that the electrolysis efficiency is reduced.

An object of the present invention is to solve the aforementioned problem.

According to an aspect of the present invention, there is provided an electrolytic cell including: a membrane electrode assembly including a fuel electrode, an oxygen electrode, and an electrolyte membrane disposed between the fuel electrode and the oxygen electrode; a pair of separators sandwiching the membrane electrode assembly; a gas supply flow path formed between the fuel electrode and one of the pair of separators along an electrode surface of the fuel electrode, a raw material gas to be supplied to the fuel electrode flowing through the gas supply flow path; and a gas discharge flow path formed between the oxygen electrode and the other of the pair of separators along an electrode surface of the oxygen electrode, an oxygen gas generated at the oxygen electrode flowing through the gas discharge flow path, wherein the fuel electrode contains a catalytic material that activates electrolytic reactions of the raw material gas, and an amount of the catalytic material contained in the fuel electrode increases from an upstream side to a downstream side of the gas supply flow path.

According to the above aspect, the electrolytic reaction sites can be dispersed in a well-balanced manner from the upstream portion of the fuel electrode to the downstream portion of the fuel electrode. As a result, a decrease in electrolysis efficiency can be suppressed. This in turn contributes to mitigation or reduction of the impact of climate change. The upstream portion of the fuel electrode is a portion corresponding to the upstream portion of the gas supply flow path. The downstream portion of the fuel electrode is a portion corresponding to the downstream portion of the gas supply flow path.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE INVENTION

Embodiment

Figure 1:
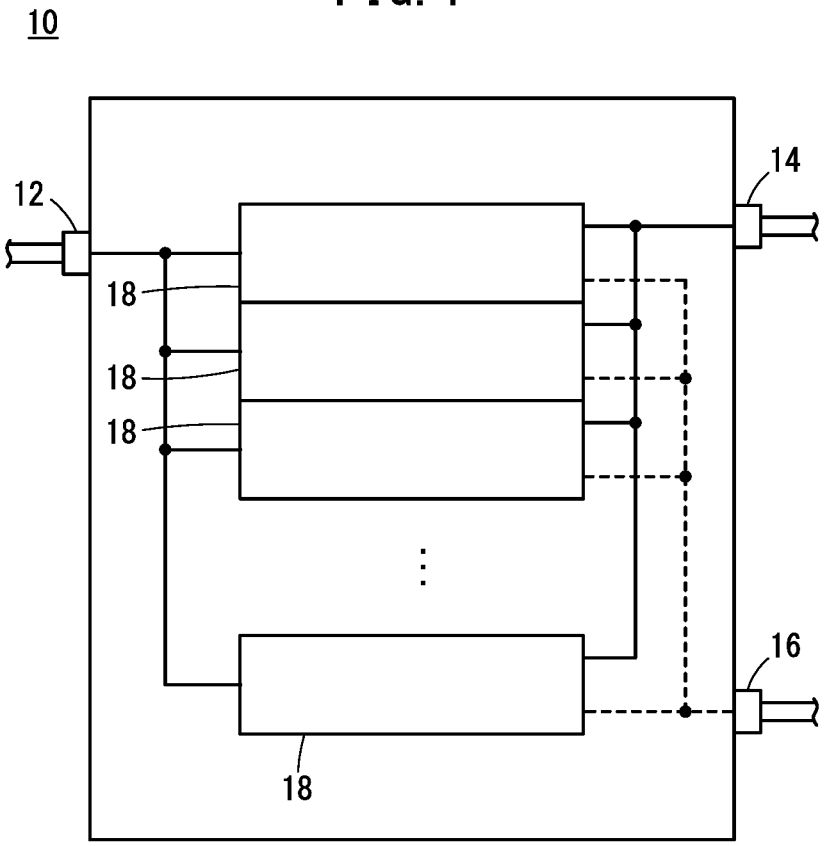
FIG. 1 is a schematic diagram showing a configuration of an electrolysis device according to an embodiment.

FIG. 1 is a schematic diagram showing the configuration of an electrolysis device 10 according to an embodiment. The electrolysis device 10 includes a raw material gas inlet 12, a synthesis gas outlet 14, an oxygen gas outlet 16, and a plurality of electrolytic cells 18.

The raw material gas inlet 12 is a portion for introducing a raw material gas into the electrolysis device 10. The raw material gas contains water vapor and carbon dioxide gas. The synthesis gas outlet 14 is a portion for taking out a synthesis gas from the electrolysis device 10. The synthesis gas contains hydrogen gas and carbon monoxide gas. The oxygen gas outlet 16 is a portion for taking out an oxygen gas from the electrolysis device 10. The raw material gas inlet 12, the synthesis gas outlet 14, and the oxygen gas outlet 16 are provided in a housing of the electrolysis device 10.

The plurality of electrolytic cells 18 are stacked. Each electrolytic cell 18 is configured to be capable of electrolyzing the raw material gas. The configuration of each electrolytic cell 18 is substantially the same. Each electrolytic cell 18 co-electrolyzes water vapor and carbon dioxide gas to produce hydrogen gas and carbon monoxide gas. Further, each electrolytic cell 18 secondarily generates oxygen gas by co-electrolysis of water vapor and carbon dioxide gas.

The electrolysis device 10 distributes the raw material gas flowing in from the raw material gas inlet 12 to each of the plurality of electrolytic cells 18. The electrolysis device collects the synthesis gas flowing out of each electrolytic cell 18 and discharges the synthesis gas from the synthesis gas outlet 14 to the outside. In addition, the electrolysis device collects the oxygen gas flowing out from each electrolytic cell 18 and discharges the oxygen gas from the oxygen gas outlet 16 to the outside.

Figure 2:
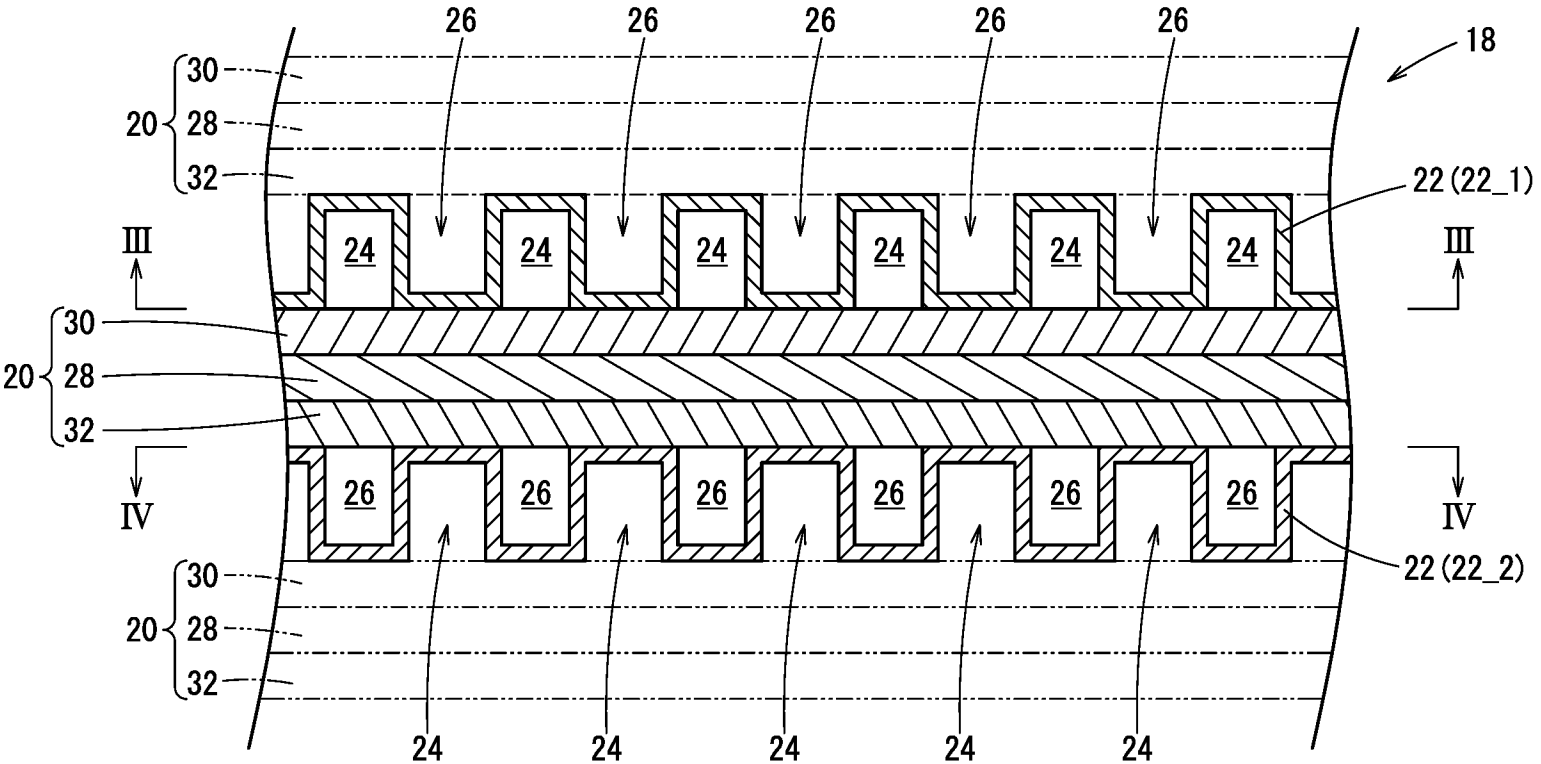
FIG. 2 is a cross-sectional view of an electrolytic cell.

FIG. 2 is a cross-sectional view showing the electrolytic cell 18. The electrolytic cell 18 includes a membrane electrode assembly 20, a pair of separators 22, a plurality of gas supply flow paths 24, and a plurality of gas discharge flow paths 26.

The membrane electrode assembly 20 may be referred to as an MEA. The membrane electrode assembly 20 includes an electrolyte membrane 28, a fuel electrode 30, and an oxygen electrode 32.

The electrolyte membrane 28 is a solid oxide electrolyte membrane. Examples of the electrolytic membrane 28 are scandia stabilized zirconia ($Sc_2O_3$ stabilized $ZrO_2$:ScSZ), yttria stabilized zirconia ($Y_2O_3$ stabilized $ZrO_2$:YSZ), or the like. One main surface of the electrolyte membrane 28 is covered with the fuel electrode 30, and the other main surface of the electrolyte membrane 28 is covered with the oxygen electrode 32.

The fuel electrode 30 is a negative electrode that receives electrons (e). The fuel electrode 30 may be referred to as a cathode. When the raw material gas is supplied to the fuel electrode 30 in a state where a voltage is applied between the fuel electrode 30 and the oxygen electrode 32, electrolytic reactions are started in the fuel electrode 30. In this case, at the fuel electrode 30, water vapor contained in the raw material gas receives electrons (e) and is reduced, and hydrogen gas and oxygen ions are generated. At the same time, the carbon dioxide gas contained in the raw material gas receives electrons (e) and is reduced to produce carbon monoxide gas and oxygen ions. The fuel electrode 30 may include a gas diffusion layer of a conductive body having a current collecting function.

The fuel electrode 30 is a porous body and has a plurality of pores. In addition, the fuel electrode 30 contains a catalytic material for electrolytic reactions (reduction reactions). Examples of the fuel electrode 30 include a mixture obtained by mixing yttria-stabilized zirconia and a catalytic material, a mixture obtained by mixing gadolinia-doped ceria ($Gd_2O_3$ doped $CeO_2$:GDC) and a catalytic material, or the like. The catalytic material is a material that activates electrolytic reactions. Examples of the catalytic material include nickel (Ni).

A reaction prevention layer for suppressing mutual diffusion between the material of the electrolyte membrane 28 and the material of the fuel electrode 30 may be disposed between the electrolyte membrane 28 and the fuel electrode 30. In this case, formation of a high-resistance solid solution at the interface between the electrolyte membrane 28 and the fuel electrode 30 is suppressed.

The oxygen electrode 32 is a positive electrode that emits electrons (e). The oxygen electrode 32 may be referred to as an anode. When the electrolytic reactions are started at the fuel electrode 30, oxygen gas is generated at the oxygen electrode 32 from oxygen ions obtained by the electrolytic reactions at the fuel electrode 30. The oxygen electrode 32 may include a gas diffusion layer of a conductive body having a current collecting function.

The oxygen electrode 32 is a porous body and has a plurality of pores. The oxygen electrode 32 contains a catalytic material for electrolytic reactions (oxidation reactions). Examples of the oxygen electrode 32 include lanthanum strontium manganite ($(La,Sr)MnO_3$:LSM), lanthanum strontium cobaltite ($(La,Sr)Co_3O_4$:LSC), or the like. LSM and LSC have catalytic ability.

A reaction prevention layer for suppressing mutual diffusion between the material of the electrolyte membrane 28 and the material of the oxygen electrode 32 may be disposed between the electrolyte membrane 28 and the oxygen electrode 32. In this case, formation of a high-resistance solid solution at the interface between the electrolyte membrane 28 and the oxygen electrode 32 is suppressed.

The pair of separators 22 sandwich the membrane electrode assembly 20. Each separator 22 is formed of metal. One of the pair of separators 22 faces the fuel electrode 30, and the other of the pair of separators 22 faces the oxygen electrode 32. In the present embodiment, the separator 22 facing the fuel electrode 30 may be referred to as a first separator 22_1. The separator 22 facing the oxygen electrode 32 may be referred to as a second separator 22_2.

The first separator 22_1 has a first surface facing the fuel electrode 30 and a second surface opposite to the first surface. The first surface of the first separator 22_1 is in contact with each gas supply flow path 24. The second surface of the first separator 22_1 is in contact with each gas discharge flow path 26 of another electrolytic cell 18 to be stacked.

The second separator 22_2 has a first surface facing the oxygen electrode 32 and a second surface opposite to the first surface. The first surface of the second separator 22_2 is in contact with each gas discharge flow path 26. The second surface of the second separator 22_2 is in contact with each gas supply flow path 24 of yet another electrolytic cell 18 to be stacked.

Figure 3:
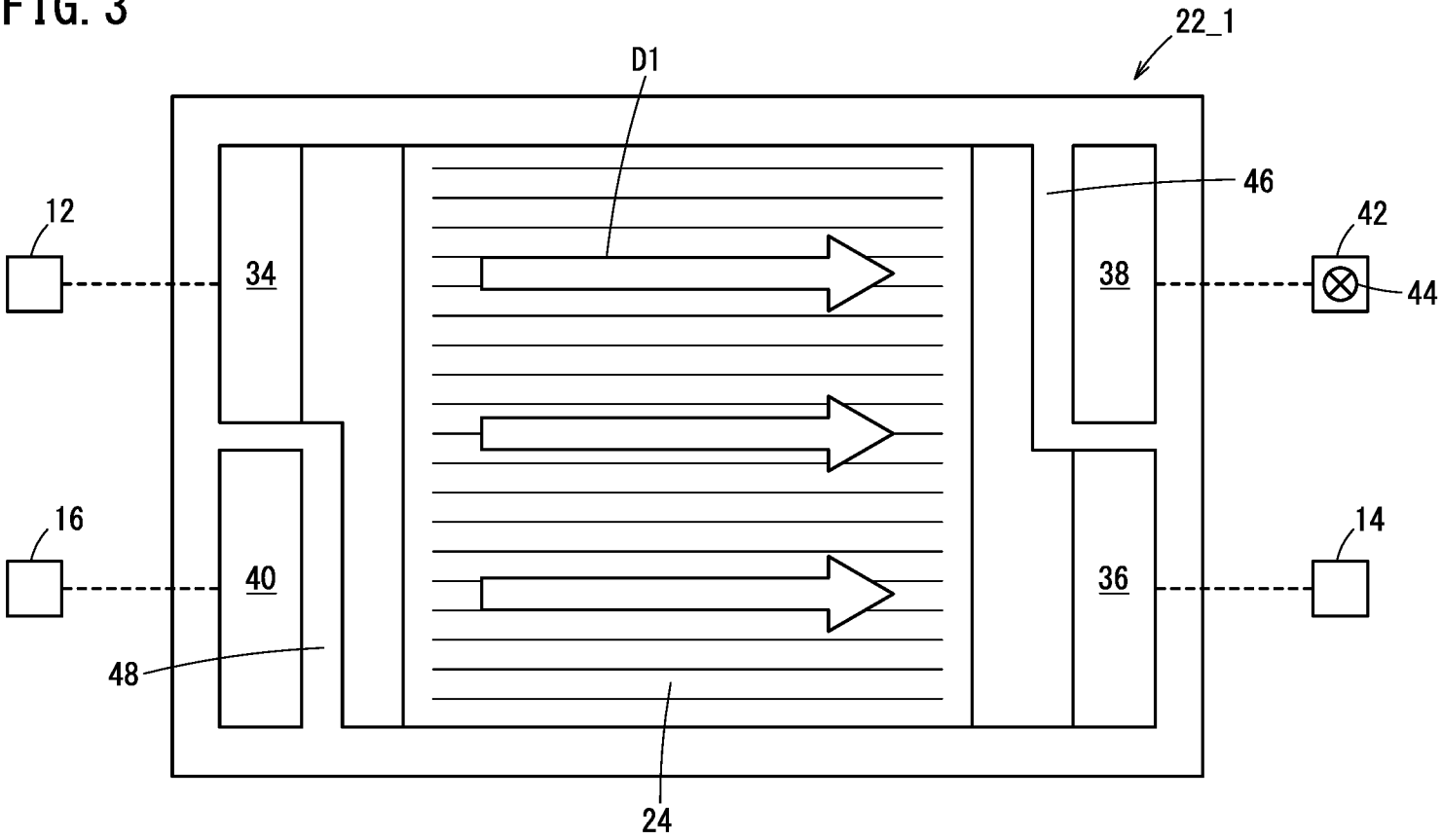
FIG. 3 is a view showing a first separator.

FIG. 3 is a view showing a first separator 22_1. Specifically, a front view of the first surface of the first separator 22_1 (a view along arrows III-III in FIG. 2) is shown. The first separator 22_1 has a fuel electrode inlet hole 34, a fuel electrode outlet hole 36, an oxygen electrode inlet hole 38, and an oxygen electrode outlet hole 40.

The fuel electrode inlet hole 34 communicates with the raw material gas inlet 12. The fuel electrode outlet hole 36 communicates with the synthesis gas outlet 14. The oxygen electrode inlet hole 38 communicates with a temporary inlet 42. The oxygen electrode outlet hole 40 communicates with the oxygen gas outlet 16. The temporary inlet 42 is provided in, for example, the housing of the electrolysis device 10. The temporary inlet 42 is provided with an opening/closing valve 44. The opening/closing valve 44 is closed when electrolysis is performed by each electrolytic cell 18. That is, when electrolysis is performed by each electrolytic cell 18, gas does not flow in from the oxygen electrode inlet hole 38.

In the first separator 22_1, the fuel electrode inlet hole 34 communicates with one end (upstream end portion) of each gas supply flow path 24. The fuel electrode outlet hole 36 communicates with the other end (downstream end portion) of each gas supply flow path 24. On the other hand, the oxygen electrode inlet hole 38 is partitioned by a partition wall portion 46 of the first separator 22_1. Similarly, the oxygen electrode outlet hole 40 is partitioned by a partition wall portion 48 of the first separator 22_1. That is, the oxygen electrode inlet hole 38 and the oxygen electrode outlet hole 40 do not communicate with any of the fuel electrode inlet hole 34, the fuel electrode outlet hole 36, and the gas supply flow paths 24.

The raw material gas flowing in from the fuel electrode inlet hole 34 of the first separator 22_1 flows to the one end of each gas supply flow path 24. The raw material gas flowing into the one end of each gas supply flow path 24 flows toward the other end of the corresponding gas supply flow path 24. The synthesis gas generated from the raw material gas in the fuel electrode 30 (FIG. 2) flows to the other end of the gas supply flow paths 24 via at least one of the plurality of gas supply flow paths 24. The raw material gas and the synthesis gas flowing out from the other end of the gas supply flow paths 24 flow out from the synthesis gas outlet 14.

Figure 4:
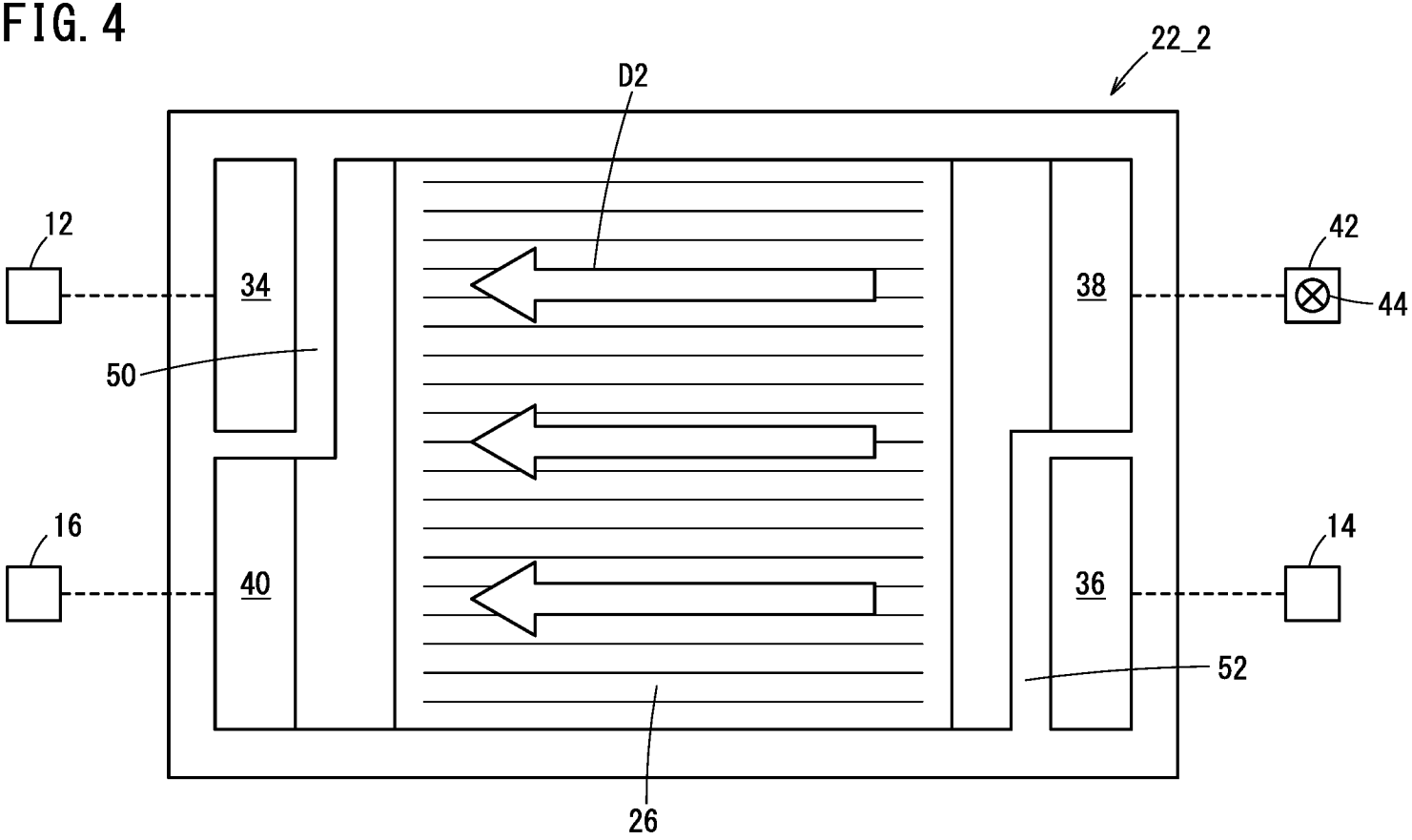
FIG. 4 is a view showing a second separator.

FIG. 4 is a view showing a second separator 22_2. Specifically, a front view of the first surface of the second separator 22_2 (a view along arrows IV-IV in FIG. 2) is shown. Similarly to the first separator 22_1, the second separator 22_2 has the fuel electrode inlet hole 34, the fuel electrode outlet hole 36, the oxygen electrode inlet hole 38, and the oxygen electrode outlet hole 40.

In the second separator 22_2, the oxygen electrode inlet hole 38 communicates with one end (upstream end portion) of each gas discharge flow path 26. The oxygen electrode outlet hole 40 communicates with the other end (downstream end portion) of each gas discharge flow path 26. On the other hand, the fuel electrode inlet hole 34 is partitioned by a partition wall portion 50 of the second separator 22_2. Similarly, the fuel electrode outlet hole 36 is partitioned by a partition wall portion 52 of the second separator 22_2. That is, the fuel electrode inlet hole 34 and the fuel electrode outlet hole 36 do not communicate with any of the oxygen electrode inlet hole 38, the oxygen electrode outlet hole 40, and the gas discharge flow paths 26.

The oxygen gas generated in the oxygen electrode 32 (FIG. 2) flows to the other end of the gas discharge flow paths 26 via at least one of the plurality of gas discharge flow paths 26. The oxygen gas flowing out from the other end of the gas discharge flow path 26 flows out from the oxygen gas outlet 16. As described above, when electrolysis is performed by the electrolytic cell 18, the opening/closing valve 44 provided in the temporary inlet 42 communicating with the oxygen electrode inlet hole 38 is closed. Therefore, the oxygen gas generated in the oxygen electrode 32 (FIG. 2) does not flow backward and is not discharged from the temporary inlet 42.

Each of the plurality of gas supply flow paths 24 is a flow path through which the raw material gas to be supplied to the fuel electrode 30 flow. Each of the plurality of gas supply flow paths 24 is also a flow path through which a synthesis gas containing hydrogen gas and carbon monoxide gas generated at the fuel electrode 30 flows. Each gas supply flow path 24 is formed between the first separator 22_1 and the fuel electrode 30 (see FIG. 2). Each gas supply flow path 24 is formed along the electrode surface of the fuel electrode 30 (see FIG. 2). The gas supply flow paths 24 are spaced apart from each other and extend side by side (see FIGS. 2 and 3). Each of the gas supply flow paths 24 may extend straight or may meander. FIG. 3 shows an example in which each gas supply flow path 24 extends straight.

In the present embodiment, the gas supply flow paths 24 are formed by grooves or the like provided on the surface of the first separator 22_1 facing the fuel electrode 30. However, the gas supply flow paths 24 may be formed by grooves or the like provided on the surface of the fuel electrode 30 facing the first separator 22_1.

Each of the plurality of gas discharge flow paths 26 is a flow path through which the oxygen gas generated at the oxygen electrode 32 flows. Each gas discharge flow path 26 is formed between the second separator 22_2 and the oxygen electrode 32 (see FIG. 2). Each gas discharge flow path 26 is formed along the electrode surface of the oxygen electrode 32 (see FIG. 2). The gas discharge flow paths 26 are spaced apart from each other and extend side by side (see FIGS. 2 and 4). Each of the gas discharge flow paths 26 may extend straight or may meander. FIG. 4 shows an example in which each gas discharge flow path 26 extends straight.

In the present embodiment, the gas discharge flow paths 26 are formed by grooves or the like provided on the surface of the second separator 22_2 facing the oxygen electrode 32. However, the gas discharge flow path 26 may be formed by grooves or the like provided on the surface of the oxygen electrode 32 facing the second separator 22_2.

The flow direction D1 (FIG. 3) of the raw material gas in the gas supply flow paths 24 is opposite to the flow direction D2 (FIG. 4) of the oxygen gas in the gas discharge flow paths 26. That is, the flow direction D1 (FIG. 3) of the raw material gas is in line with the opposite direction of the flow direction D2 (FIG. 4) of the oxygen gas. Similarly, the oxygen gas flow direction D2 (FIG. 4) is in line with the direction opposite to the raw material gas flow direction D1 (FIG. 3). In other words, the upstream portion of the gas supply flow path 24 positionally corresponds to the downstream portion of the gas discharge flow path 26 in the thickness direction of the electrolytic cell 18 (the stacking direction of the electrolytic cells 18) (see FIG. 2). The downstream portion of the gas supply flow path 24 positionally corresponds to the upstream portion of the gas discharge flow path 26 in the thickness direction of the electrolytic cell 18 (the stacking direction of the electrolytic cells 18) (see FIG. 2).

Figure 5:
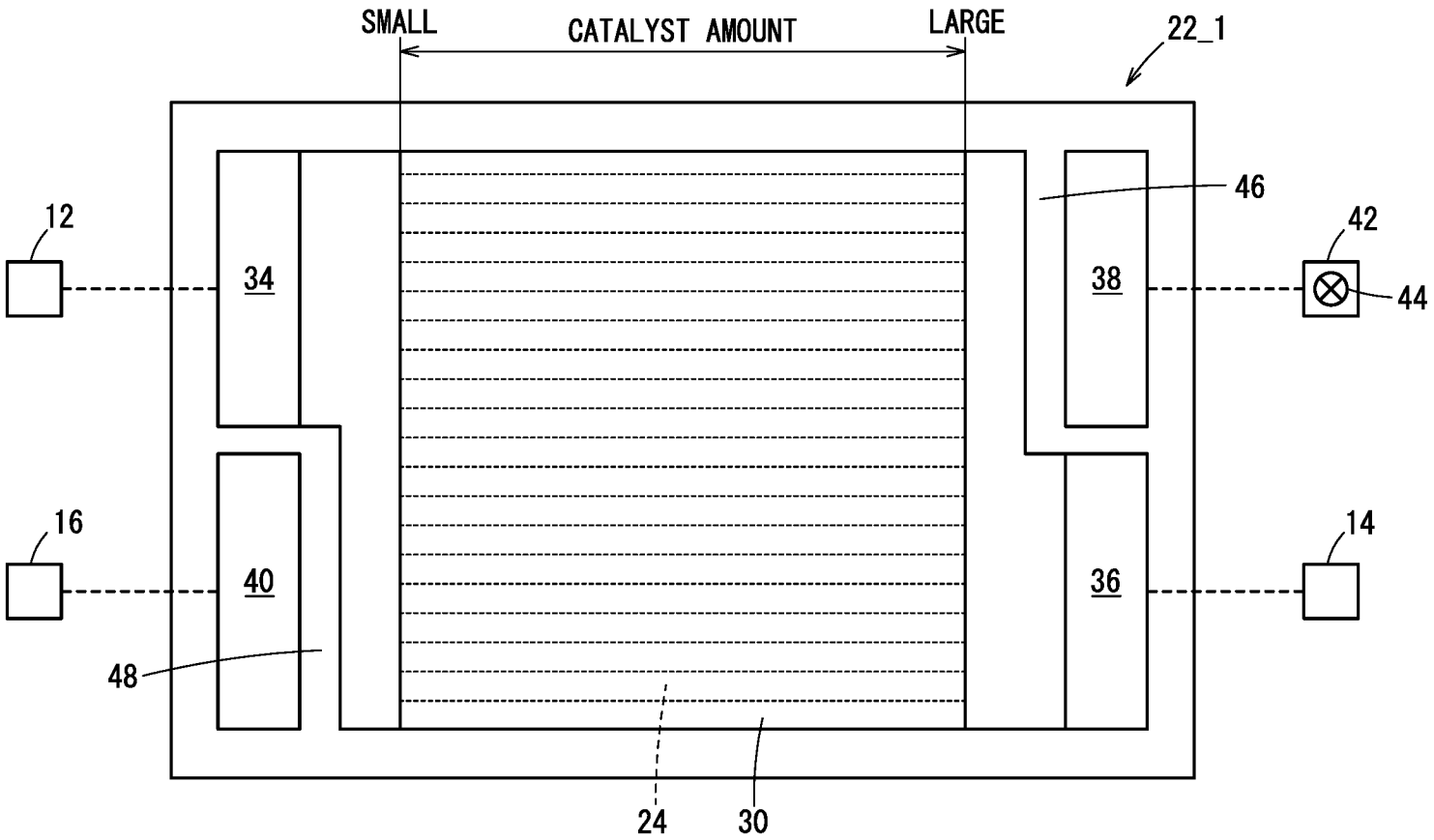
FIG. 5 is a diagram on which a change in amount of catalyst contained in the fuel electrode is shown.

FIG. 5 is a diagram on which a change in amount of catalyst contained in the fuel electrode 30 is shown. In this embodiment, the amount of catalyst contained in the fuel electrode 30 gradually increases from the upstream side to the downstream side of the gas supply flow paths 24. The amount of catalyst contained in the oxygen electrode 32 may be constant throughout the gas discharge flow paths 26. The amount of catalyst means the amount of the catalytic material.

Figure 6A:
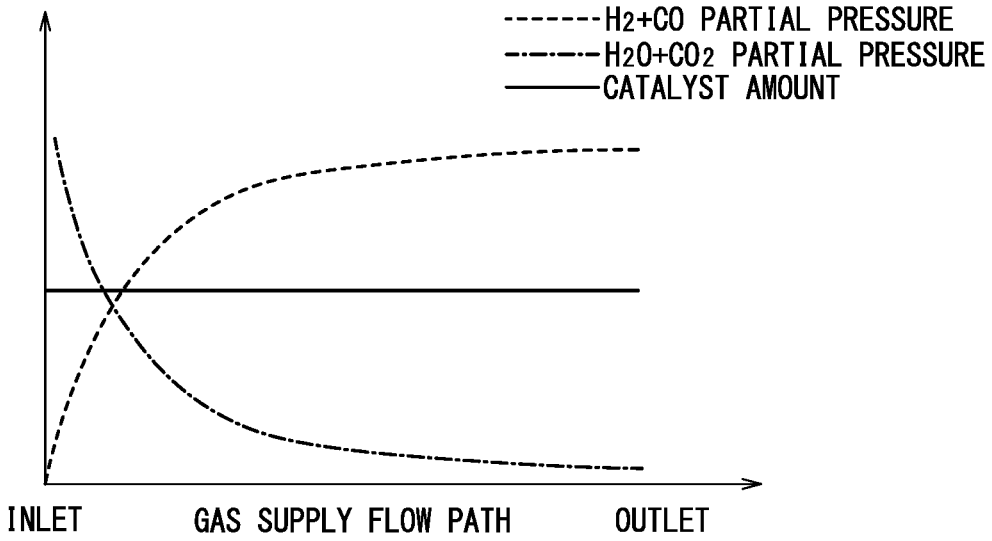
FIG. 6A is a graph showing a change in partial pressure of a specific gas in a comparative example.
Figure 6B:
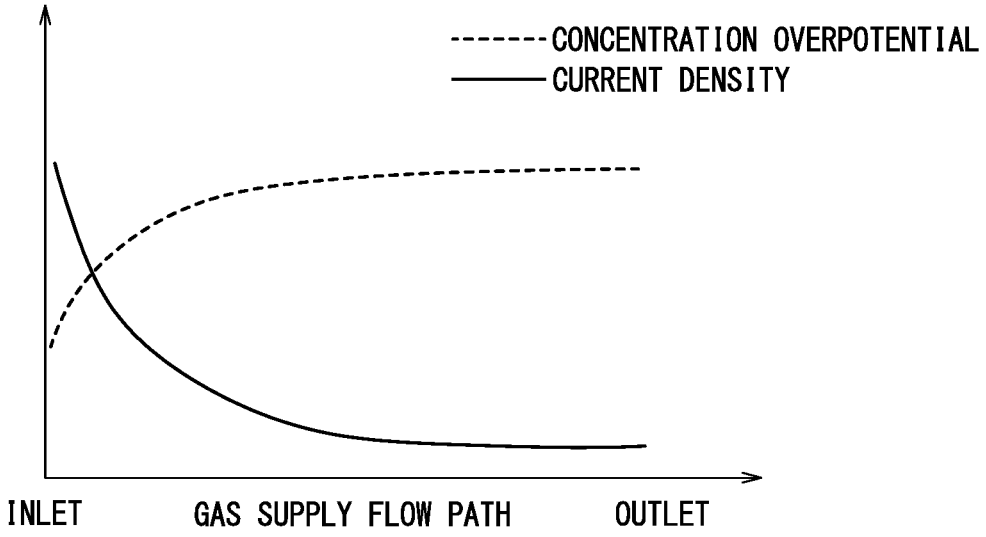
FIG. 6B is a graph showing changes in concentration overpotential and current density in a comparative example.

FIG. 6A is a graph showing changes in partial pressures of specific gases in a comparative example. FIG. 6B is a graph showing changes in concentration overpotential and current density in the comparative example. In the comparative example, the amount of catalyst contained in the fuel electrode 30 is substantially constant from the upstream side to the downstream side of the gas supply flow paths 24.

In the case of the comparative example, the partial pressures of water vapor and carbon dioxide gas rapidly decrease from the inlet of the gas supply flow path 24 (see FIG. 6A). In addition, the partial pressures of hydrogen gas and carbon monoxide gas obtained by the electrolysis rapidly increase from the inlet of the gas supply flow path 24 (see FIG. 6A).

That is, in the case of the comparative example, the electrolytic reaction sites are concentrated in the upstream portion of the fuel electrode 30. In other words, the electrolytic reaction sites gather at the end of the fuel electrode 30. Therefore, the current density in the electrode surface rapidly decreases from the upstream side to the downstream side of the gas supply flow path 24 (see FIG. 6B). In addition, the concentration overpotential rapidly increases from the upstream side to the downstream side of the gas supply flow path 24 (see FIG. 6B). As a result, the electrolysis efficiency is reduced.

In addition, in the case of the comparative example, carbon tends to be deposited in the upstream portion of the fuel electrode 30 where the electrolytic reaction sites are concentrated. When carbon is deposited, the catalytic activities decrease. As a result, not only the reduction of the electrolysis efficiency but also the deterioration of the electrolytic cell 18 is accelerated.

Figure 7A:
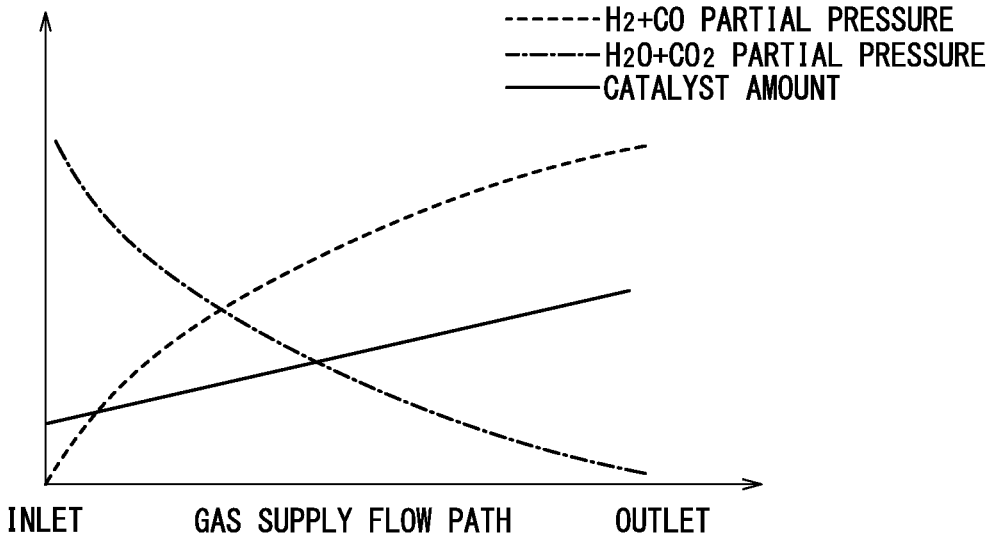
FIG. 7A is a graph showing a change in partial pressure of a specific gas in the embodiment.
Figure 7B:
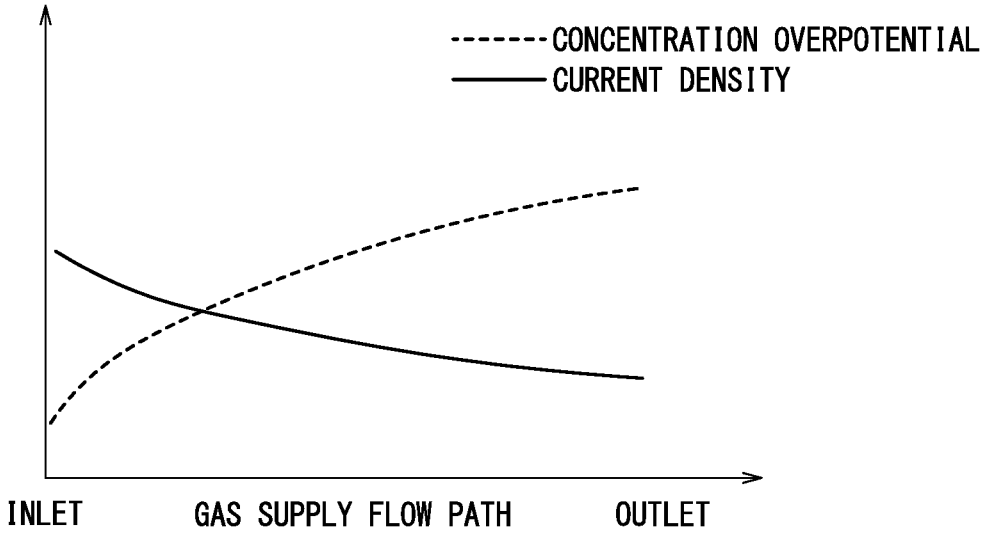
FIG. 7B is a graph showing changes in concentration overpotential and current density in the embodiment.

FIG. 7A is a graph showing changes in partial pressures of specific gases in the embodiment. FIG. 7B is a graph showing changes in concentration overpotential and current density in the embodiment. As described above, in this embodiment, the amount of catalyst contained in the fuel electrode 30 gradually increases from the upstream side to the downstream side of the gas supply flow paths 24 (see FIGS. 5 and 7A).

In the case of the present embodiment, the partial pressures of water vapor and carbon dioxide gas gradually decrease from the inlet to the outlet of the gas supply flow paths 24 (see FIG. 7A). In addition, the partial pressures of hydrogen gas and carbon monoxide gas obtained by electrolysis gradually increase from the inlet to the outlet of the gas supply flow path 24 (see FIG. 7A).

That is, in the case of the present embodiment, the electrolytic reaction sites are distributed in a well-balanced manner from the upstream portion of the fuel electrode 30 to the downstream portion of the fuel electrode 30. In other words, electrolytic reaction sites are secured throughout the fuel electrode 30. As a result, a decrease in electrolysis efficiency can be suppressed. In addition, since carbon is less likely to be deposited, it is possible to suppress acceleration of deterioration in the electrolytic cell 18.

The co-electrolysis reaction of water vapor and carbon dioxide gas is an endothermic reaction, and the temperature of the electrolytic cell 18 upstream of the fuel electrode 30 decreases. In the co-electrolysis reaction, carbon is more easily deposited on the fuel electrode 30 as the operating temperature is lower. In the present embodiment, the flow direction D1 (FIG. 3) of the raw material gas in the gas supply flow paths 24 is opposite to the flow direction D2 (FIG. 4) of the oxygen gas in the gas discharge flow paths 26. Therefore, the temperature of the upstream portion of the fuel electrode 30 can be increased. As a result, it is possible to suppress deposition of carbon in the upstream portion of the fuel electrode 30. In addition, the heat generated at the oxygen electrode 32 can be transported upstream in the gas supply flow paths 24 and used for the co-electrolysis reaction (reduction reaction of water vapor and carbon dioxide gas) which is an endothermic reaction. The heat generated at the oxygen electrode 32 becomes an overvoltage due to the transfer resistance of oxygen ions obtained by the reduction reaction of the water vapor and the carbon dioxide gas.

MODIFICATIONS

The above-described embodiment may be modified in the following manner.

Modified Embodiment 1

Figure 8:
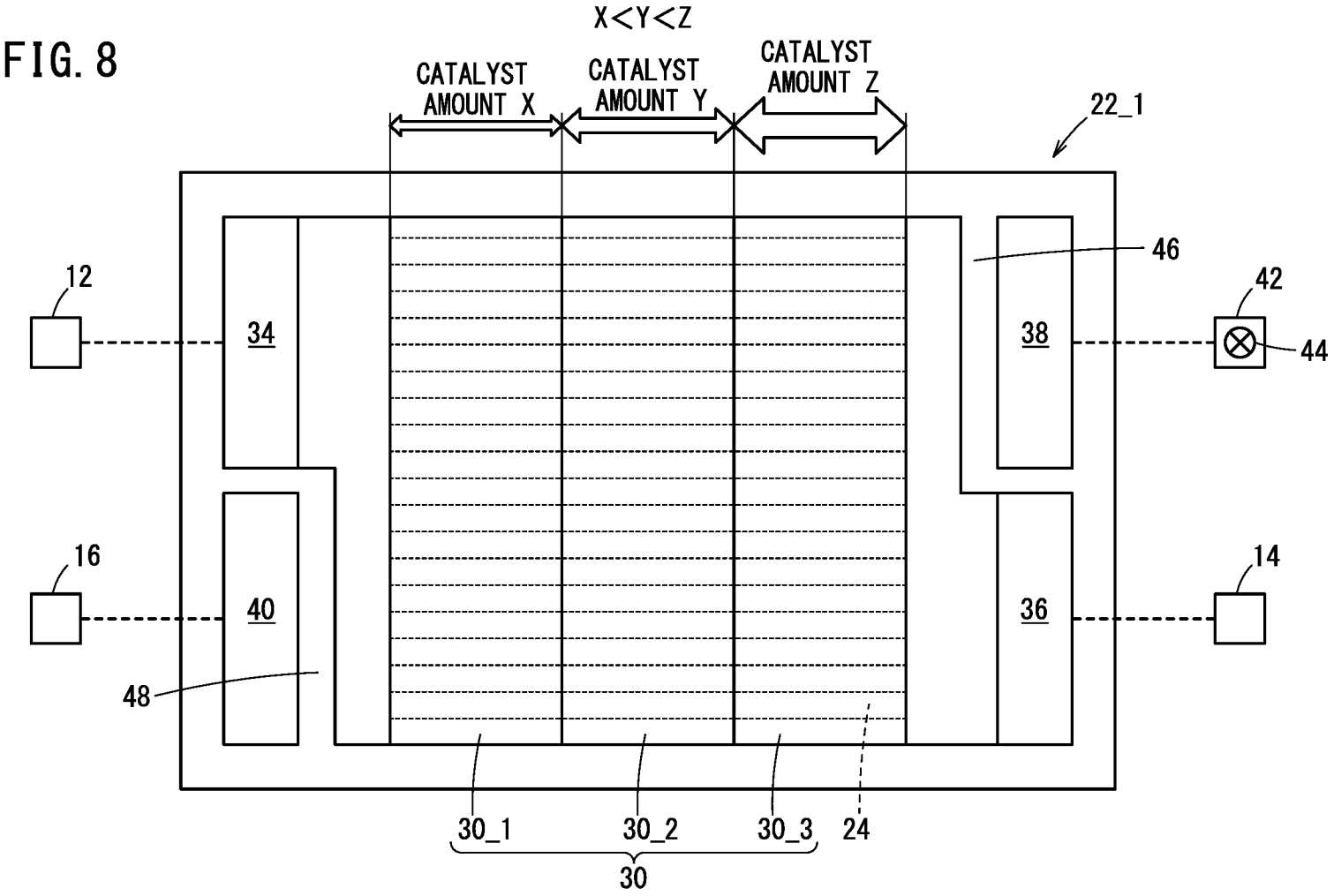
FIG. 8 is a diagram on which a change in amount of catalyst contained in the fuel electrode in the modified embodiment 1 is shown.

FIG. 8 is a diagram on which a change in amount of catalyst contained in the fuel electrode 30 in the modified embodiment 1 is shown. In FIG. 8, the same reference numerals are assigned to the same constituent elements as those described in the embodiment. In the present modification, description overlapping with that of the embodiment is omitted.

In the present modification, the fuel electrode 30 is divided into a plurality of electrode sections 30_*n*. The number n as the number of divided electrode sections is an integer of 2 or more. FIG. 8 illustrates an example in which the number n as the number of divided electrode sections is "3". That is, in FIG. 8, the fuel electrode 30 is divided into a first electrode section 30_1, a second electrode section 30_2, and a third electrode section 30_3.

The first electrode section 30_1 is disposed upstream of the second electrode section 30_2 and the third electrode section 30_3 in the gas supply flow paths 24. The amount of catalyst contained in the first electrode section 30_1 is smaller than the amount of catalyst contained in the second electrode section 30_2 and the amount of catalyst contained in the third electrode section 30_3.

The second electrode section 30_2 is disposed downstream of the first electrode section 30_1 and upstream of the third electrode section 30_3 in the gas supply flow paths 24. The amount of catalyst contained in the second electrode section 30_2 is larger than the amount of catalyst contained in the first electrode section 30_1 and smaller than the amount of catalyst contained in the third electrode section 30_3.

The third electrode section 30_3 is disposed downstream of the first electrode section 30_1 and the second electrode section 30_2 in the gas supply flow paths 24. The amount of catalyst contained in the third electrode section 30_3 is larger than the amount of catalyst contained in the first electrode section 30_1 and the amount of catalyst contained in the second electrode section 30_2.

In the present modification, the electrode areas of the first electrode section 30_1, the second electrode section 30_2, and the third electrode section 30_3 are the same as each other, but may be different from each other. The thicknesses of the first electrode section 30_1, the second electrode section 30_2, and the third electrode section 30_3 are substantially the same.

Figure 9A:
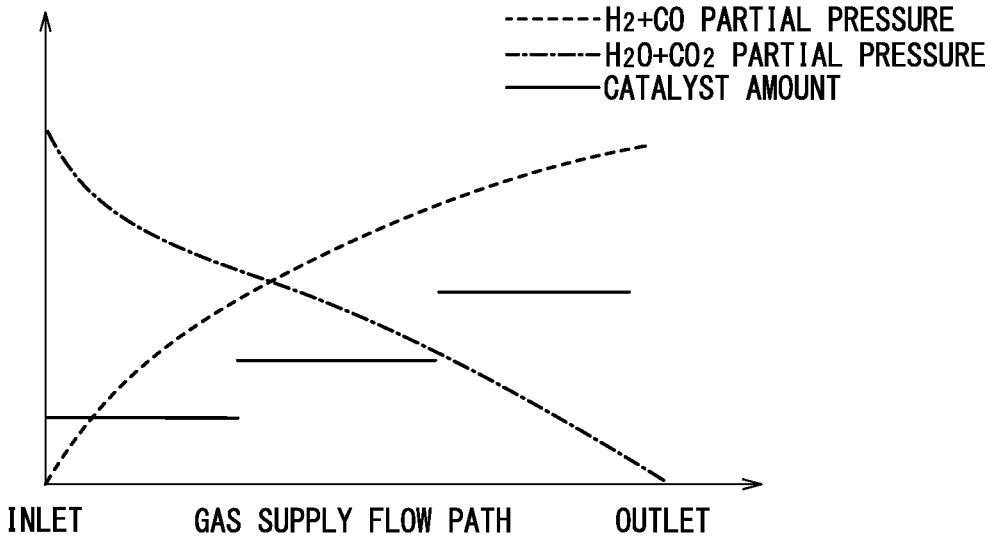
FIG. 9A is a graph showing a change in a partial pressure of a specific gas in the modified embodiment 1.
Figure 9B:
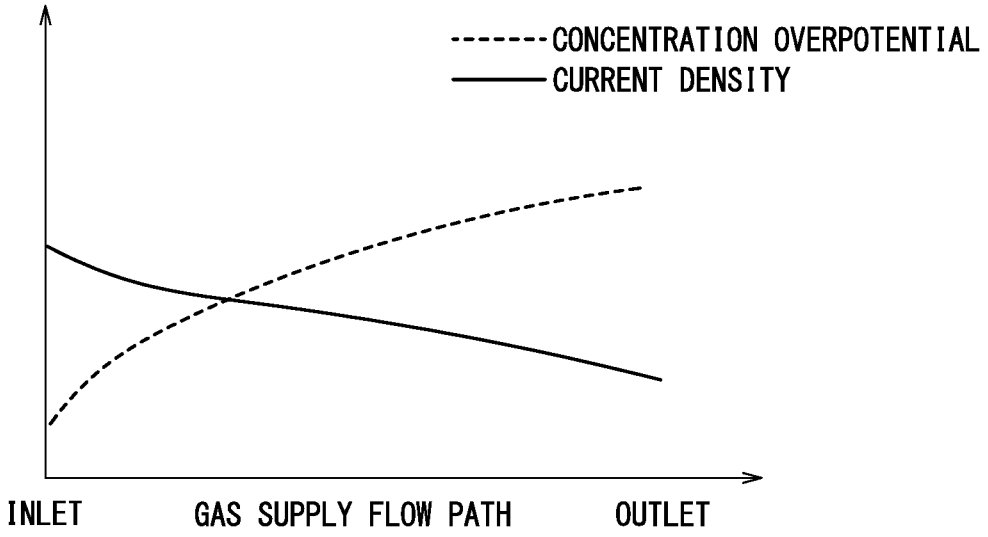
FIG. 9B is a graph showing changes in concentration overpotential and current density in the modified embodiment 1.

FIG. 9A is a graph showing changes in partial pressures of specific gases in the modified embodiment 1. FIG. 9B is a graph showing changes in concentration overpotential and current density in the modified embodiment 1. In this modified embodiment, the amount of catalysts contained in the fuel electrode 30 is set into three stages from the upstream side to the downstream side of the gas supply flow paths 24 (see the 9A portion of FIGS. 8 and 9A).

In the case of the present modified embodiment, the partial pressures of water vapor and carbon dioxide gas gradually decrease from the inlet toward the outlet of the gas supply flow paths 24 (see FIG. 9A). In addition, the partial pressures of hydrogen gas and carbon monoxide gas obtained by the electrolysis gradually increase from the inlet to the outlet of the gas supply flow paths 24 (see FIG. 9A).

That is, in the case of the present modification, as in the embodiment, the electrolytic reaction sites are dispersed in a well-balanced manner from the upstream portion of the fuel electrode 30 to the downstream portion of the fuel electrode 30. As a result, a decrease in electrolysis efficiency can be suppressed. In addition, since carbon is less likely to be deposited, it is possible to suppress acceleration of deterioration in the electrolytic cell 18.

As described above, in the present modification, the fuel electrode 30 is divided into a plurality of electrode sections 30_*n* so that the amount of catalyst increases stepwise from the upstream side to the downstream side of the gas supply flow paths 24. Even in this case, the same effect as that of the embodiment can be obtained.

Modified Embodiment 2

Figure 10:
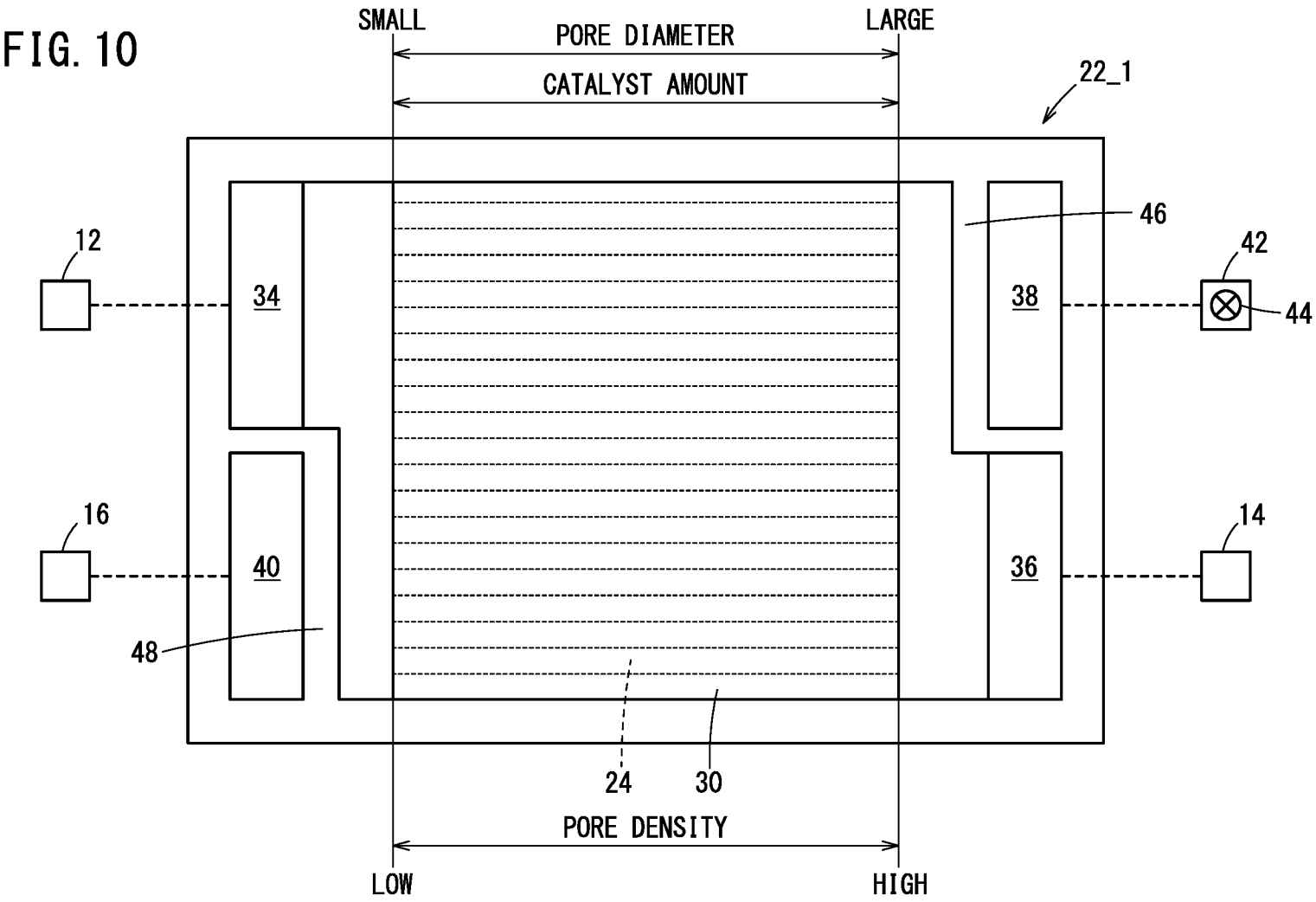
FIG. 10 is a diagram on which a change in amount of catalyst contained in the fuel electrode, the pore diameter, and the pore density in the modified embodiment 2 is shown.

FIG. 10 is a diagram on which changes in amount of catalyst contained in the fuel electrode 30, the pore diameter, and the pore density in modified embodiment 2 are shown. In FIG. 10, the same components as those described in the embodiment are denoted by the same reference numerals. In the present modification, description overlapping with that of the embodiment is omitted.

In this modified embodiment, as in the embodiment, the amount of catalyst contained in the fuel electrode 30 gradually increases from the upstream side to the downstream side of the gas supply flow paths 24. The pore diameter and the pore density of the fuel electrode 30 gradually increase from the upstream side to the downstream side of the gas supply flow paths 24.

The pore size can be defined, for example, as the average of diameters of pores per unit volume. The pore density is a density of pores per unit volume. The pore size and pore density are adjustable. For example, a precursor of the fuel electrode 30 is obtained by mixing a pore-forming material with a raw material of the fuel electrode 30, and then the pore-forming material is melted and evaporated. The fuel electrode 30 is obtained in this manner. In this case, the pore size can be adjusted based on the diameter of the pore-forming material. Also, the pore density can be adjusted based on the amount of the pore-forming material.

It is known that the gas diffusion mode varies depending on the pore diameter. Specifically, the ratio of the pore diameter to the mean free path of gas molecules determines which diffusion becomes dominant, molecular diffusion or Knudsen diffusion. Molecular diffusion is caused by collision between gas molecules. Knudsen diffusion is caused by collision between gas molecules and the pore wall surfaces, and becomes smaller as the molecular weight of the gas becomes larger. In the case of this embodiment, the pore diameter of the fuel electrode 30 is preferably set based on the molecular weight of the gas in the raw material gas so that the Knudsen diffusion does not become dominant.

In the case of this modification, not only the amount of catalyst contained in the fuel electrode 30 but also the pore diameter and pore density of the fuel electrode 30 gradually increase from the upstream side to the downstream side of the gas supply flow paths 24. Therefore, the electrolytic reaction sites in the fuel electrode 30 can be further dispersed in a well-balanced manner.

The pore diameter or pore density of the fuel electrode 30 may be substantially uniform from the upstream side to the downstream side of the gas supply flow paths 24. "Uniform" means that the ratio of the minimum value to the maximum value is equal to or less than a predetermined threshold. The predetermined threshold is set to, for example, 10%.

Modified Embodiment 3

Figure 11:
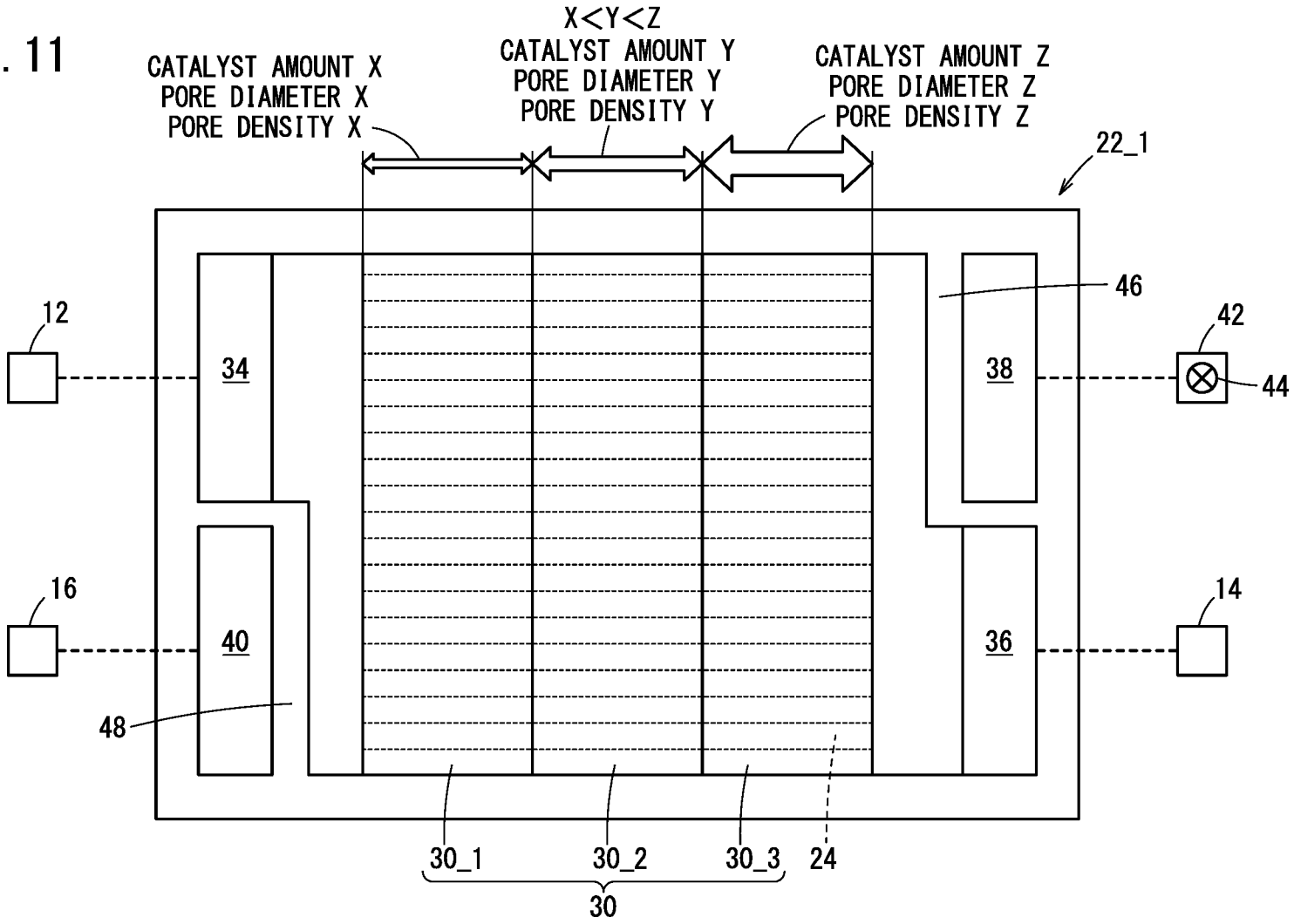
FIG. 11 is a diagram on which a change in amount of catalyst contained in the fuel electrode, the pore diameter, and the pore density in the modified embodiment 3 is shown.

FIG. 11 is a schematic diagram showing the amount of catalyst contained in the fuel electrode 30, the pore diameter, and the pore density in modified embodiment 3. In FIG. 11, the same components as those described in the embodiment are denoted by the same reference numerals. In the present modification, description overlapping with that of the embodiment is omitted.

In the present modification, the fuel electrode 30 is divided into a plurality of electrode sections 30_*n*, as in the modified embodiment 1. FIG. 11 illustrates an example in which the number n as the number of divided electrode sections is "3". That is, in FIG. 11, the fuel electrode 30 is divided into a first electrode section 30_1, a second electrode section and a third electrode section 30_3.

The first electrode section 30_1 is disposed upstream of the second electrode section 30_2 and the third electrode section 30_3 in the gas supply flow paths 24. The amount of catalyst contained in the first electrode section 30_1 is smaller than the amount of catalyst contained in the second electrode section 30_2 and the amount of catalyst contained in the third electrode section 30_3. Further, the pore diameter in the first electrode section 30_1 is smaller than the pore diameter in the second electrode section 30_2 and the pore diameter in the third electrode section 30_3. In addition, the pore density in the first electrode section 30_1 is smaller than the pore density in the second electrode section 30_2 and the pore density in the third electrode section 30_3.

The second electrode section 30_2 is disposed downstream of the first electrode section 30_1 and upstream of the third electrode section 30_3 in the gas supply flow paths 24. The amount of catalyst contained in the second electrode section 30_2 is larger than the amount of catalyst contained in the first electrode section 30_1 and smaller than the amount of catalyst contained in the third electrode section 30_3. Furthermore, the pore diameter in the second electrode section 30_2 is larger than the pore diameter in the first electrode section 30_1 and smaller than the pore diameter in the third electrode section 30_3. In addition, the pore density in the second electrode section 30_2 is larger than the pore density in the first electrode section 30_1 and smaller than the pore density in the third electrode section 30_3.

The third electrode section 30_3 is disposed downstream of the gas supply flow path 24 with respect to the first electrode section 30_1 and the second electrode section 30_2. The amount of catalyst contained in the third electrode section 30_3 is larger than the amount of catalyst contained in the first electrode section 30_1 and the amount of catalyst contained in the second electrode section 30_2. Further, the pore diameter in the third electrode section 30_3 is larger than the pore diameter in the first electrode section 30_1 and the pore diameter in the second electrode section 30_2. In addition, the pore density in the third electrode section 30_3 30_1 is higher than the pore density in the first electrode section and the pore density in the second electrode section 30_2.

As described above, in the present modification, the fuel electrode 30 is divided into a plurality of electrode sections 30_*n* from the upstream side to the downstream side of the gas supply flow paths 24 so that not only the amount of catalyst but also the pore diameter and the pore density increase in a stepwise manner. Therefore, the electrolytic reaction sites in the fuel electrode 30 can be further dispersed in a well-balanced manner.

Modified Embodiment 4

Figure 12:
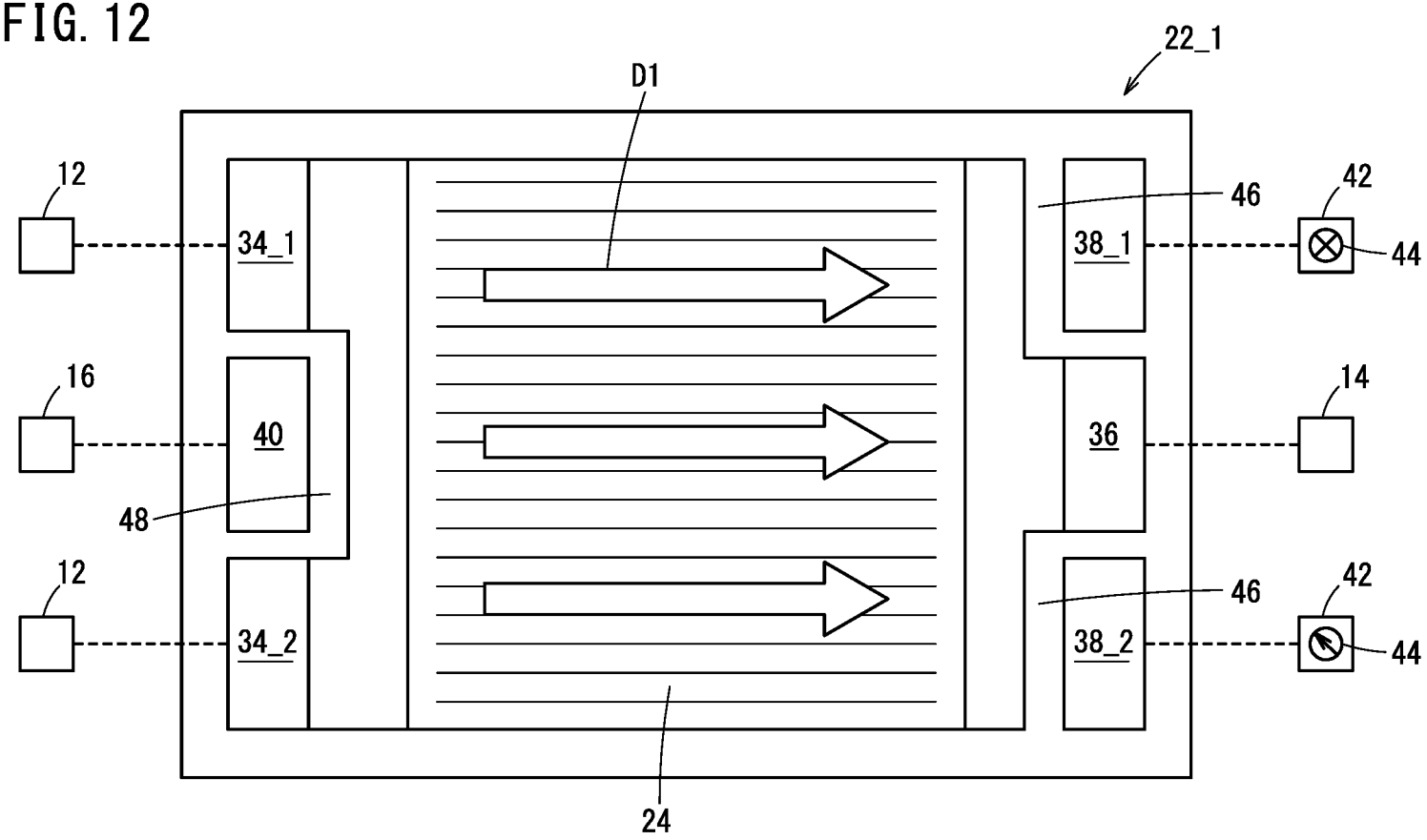
FIG. 12 is a diagram illustrating a first separator according to the modified embodiment 4.

FIG. 12 is a diagram illustrating a first separator 22_1 according to the modified embodiment 4. Specifically, a front view of the first surface of the first separator 22_1 (a view along arrows III-III in FIG. 2) is shown. In FIG. 12, the same components as those described in the embodiment are denoted by the same reference numerals. In the present modification, description overlapping with that of the embodiment is omitted.

The first separator 22_1 of the present modification has a plurality of fuel electrode inlet holes 34. The first separator 22_1 of the present modification has a plurality of oxygen electrode inlet holes 38. FIG. 12 shows an example in which the number of fuel electrode inlet holes 34 is two and the number of oxygen electrode inlet holes 38 is two.

The two fuel electrode inlet holes 34_1, 34_2 are spaced apart from each other such that the oxygen electrode outlet hole 40 is positioned between the fuel electrode inlet holes 34_1, 34_2. Each of the fuel electrode inlet holes 34_1, 34_2 communicates with the one end (upstream end portion) of the gas supply flow paths 24. The sum of the opening areas of the fuel electrode inlet holes 34_1, 34_2 is larger than the opening area of the fuel electrode outlet hole 36.

The two oxygen electrode inlet holes 38_1, 38_2 are spaced apart from each other such that the fuel electrode outlet hole 36 is positioned between the oxygen electrode inlet holes 38_1, 38_2. The oxygen electrode inlet holes 38_1, 38_2 are partitioned by the partition wall portion 46 of the first separator 22_1.

In the present modification, the raw material gas is supplied to the one end of respective gas supply flow paths 24 from both of the two fuel electrode inlet holes 34_1, 34_2. Therefore, even if the supply pressure of the raw material gas is low, the raw material gas can be uniformly distributed to respective gas supply flow paths 24 more easily than in the case of only one fuel electrode inlet hole 34. As a result, it is possible to prevent electrolytic reactions from being dispersed unevenly in the fuel electrode 30 due to a difference in the amount of the raw material gas distributed to the gas supply flow paths 24.

Figure 13:
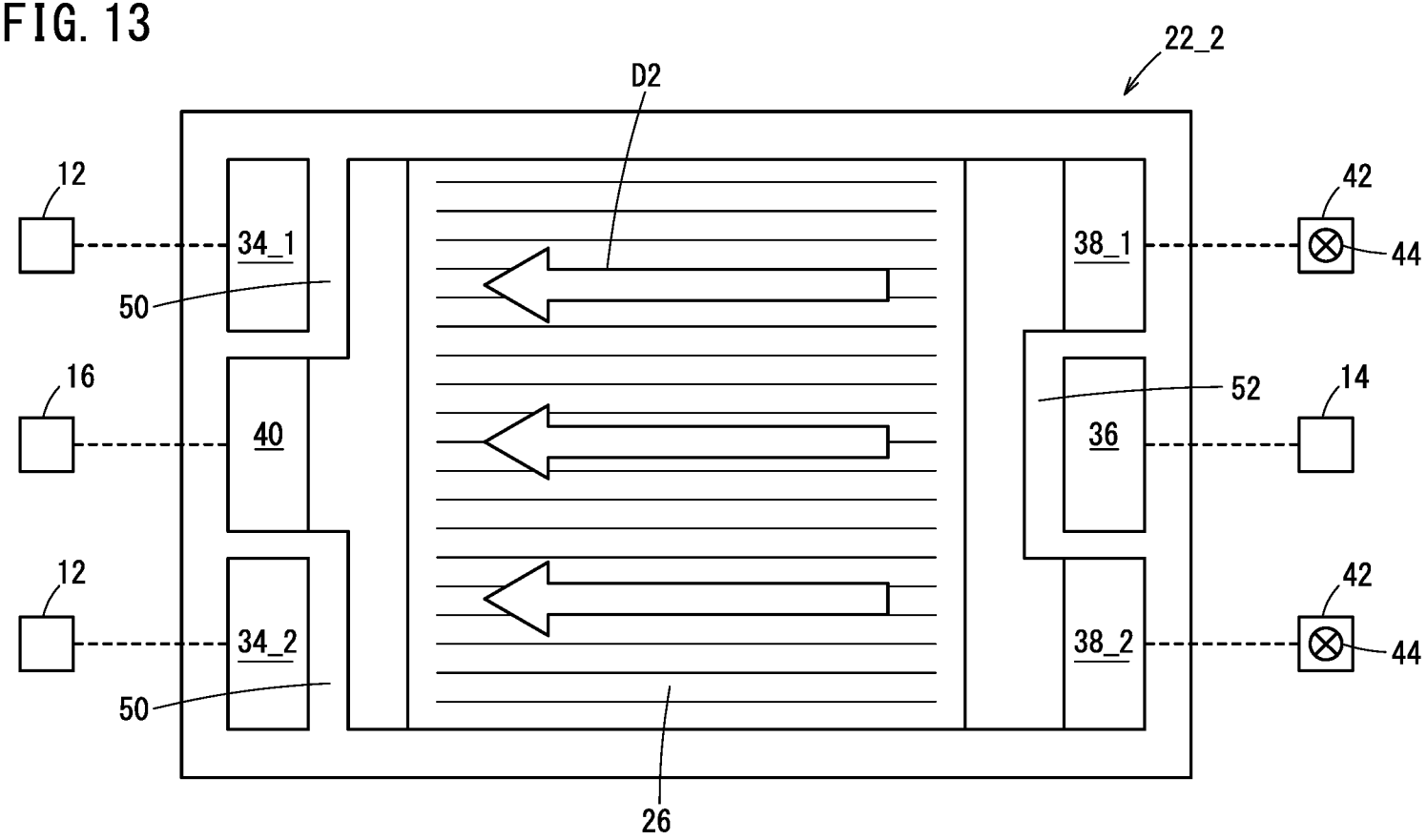
FIG. 13 is a diagram illustrating a second separator according to the modified embodiment 4.

FIG. 13 is a diagram illustrating a second separator 22 according to the modified embodiment 4. Specifically, a front view of the first surface of the second separator 22_2 (a view along arrows IV-IV in FIG. 2) is shown. In FIG. 13, the same components as those described in the embodiment are denoted by the same reference numerals. In the present modification, description overlapping with that of the embodiment is omitted.

Similarly to the first separator 22_1, the second separator 22_2 of the present modification has a plurality of fuel electrode inlet holes 34 and a plurality of oxygen electrode inlet holes 38. FIG. 13 shows an example in which the number of fuel electrode inlet holes 34 is two and the number of oxygen electrode inlet holes 38 is two.

The fuel electrode inlet holes 34_1, 34_2 of the second separator 22_2 are partitioned by the partition wall portion 50 of the second separator 22_2. Each of the oxygen electrode inlet holes 38_1, 38_2 communicates with the one end (upstream end portion) of each of the gas discharge flow paths 26.

In this modification, a gas such as a cleaning gas can be supplied from both of the two oxygen electrode inlet holes 38_1, 38_2 to the one end of each of the gas discharge flow paths 26. Therefore, compared to the case where only one oxygen electrode inlet hole 38 is provided, even if the supply pressure of the gas such as the cleaning gas is low, the gas can be easily uniformly distributed to each of the gas discharge flow paths 26.

When electrolysis is performed by the electrolytic cell 18, the opening/closing valves 44 provided in the temporary inlets 42 are closed. Therefore, similarly to the embodiment, the oxygen gas generated in the oxygen electrode 32 (FIG. 2) does not flow backward and is not discharged from the temporary inlets 42.

Modified Embodiment 5

The embodiment and the modified embodiments 1 to 4 may be arbitrarily combined within a range in which the combinations do not deviate from the object of the present invention.

(1) The present invention is the electrolytic cell (18) including: the membrane electrode assembly (20) including the fuel electrode (30), the oxygen electrode (32), and the electrolyte membrane (28) disposed between the fuel electrode and the oxygen electrode; the pair of separators (22) sandwiching the membrane electrode assembly; the gas supply flow path (24) formed between the fuel electrode and one of the pair of separators along the electrode surface of the fuel electrode, the raw material gas to be supplied to the fuel electrode flowing through the gas supply flow path; and the gas discharge flow path (26) formed between the oxygen electrode and the other of the pair of separators along the electrode surface of the oxygen electrode, the oxygen gas generated at the oxygen electrode flowing through the gas discharge flow path, wherein the fuel electrode contains a catalytic material that activates electrolytic reactions of the raw material gas, and the amount of the catalytic material contained in the fuel electrode increases from the upstream side to the downstream side of the gas supply flow path.

With this arrangement, the electrolytic reaction sites can be dispersed in a well-balanced manner from the upstream portion of the fuel electrode to the downstream portion of the fuel electrode. As a result, a decrease in electrolysis efficiency can be suppressed. In addition, deposition of carbon due to concentration of the electrolytic reaction sites can be suppressed, and as a result, acceleration of deterioration of the electrolytic cell can be suppressed.

(2) In the electrolytic cell of the present invention, a flow direction (D1) of the raw material gas in the gas supply flow path may be opposite to a flow direction (D2) of the oxygen gas in the gas discharge flow path. In this way, it is possible to increase the temperature of the upstream portion of the fuel electrode where the temperature tends to decrease due to an endothermic reaction (reduction reaction of carbon dioxide gas) caused by electrolysis. As a result, it is possible to suppress deposition of carbon in the upstream portion of the fuel electrode. In addition, the heat generated at the oxygen electrode can be transported upstream in the gas supply flow paths and used for the electrolysis reaction (reduction reaction of carbon dioxide gas) which is an endothermic reaction.

(3) In the electrolytic cell of the present invention, the amount of the catalytic material contained in the fuel electrode may gradually increase from the upstream to the downstream of the gas supply flow path. Thus, the electrolytic reaction sites can be dispersed in a well-balanced manner.

(4) In the electrolytic cell of the present invention, the fuel electrode may include the first electrode section (30_1) and the second electrode section (30_2) having the larger amount of the catalytic material than the first electrode section, and the first electrode section may be disposed upstream of the second electrode section in the gas supply flow path. Thus, the electrolytic reaction sites can be dispersed in a well-balanced manner.

(5) In the electrolytic cell according to the invention, the fuel electrode may have a plurality of pores, and a pore diameter of the pores may increase from the upstream to the downstream of the gas supply flow path. Thus, the electrolytic reaction sites can further be dispersed in a well-balanced manner.

(6) In the electrolytic cell of the present invention, the fuel electrode may have a plurality of pores, and a density of the pores per unit volume may increase from the upstream to the downstream of the gas supply flow path. Thus, the electrolytic reaction sites can further be dispersed in a well-balanced manner.

(7) In the electrolytic cell of the present invention, the amount of the catalytic material contained in the oxygen electrode may be constant from an upstream side to a downstream side of the gas discharge flow path. This makes it unnecessary to adjust the amount of the catalyst contained in the oxygen electrode.

Moreover, the present invention is not limited to the above-described disclosure, and various configurations can be adopted therein without departing from the essence and gist of the present invention.

The invention claimed is:

1. An electrolytic cell including: a membrane electrode assembly comprising a fuel electrode, an oxygen electrode, and an electrolyte membrane disposed between the fuel electrode and the oxygen electrode;

pair of separators sandwiching the membrane electrode assembly;

a gas supply flow path formed between the fuel electrode and one of the pair of separators along an electrode surface of the fuel electrode, a raw material gas to be supplied to the fuel electrode flowing through the gas supply flow path; and a gas discharge flow path formed between the oxygen electrode and another of the pair of separators along an electrode surface of the oxygen electrode, an oxygen gas generated at the oxygen electrode flowing through the gas discharge flow path, wherein the fuel electrode contains a catalytic material that activates electrolytic reactions of the raw material gas, an amount of the catalytic material contained in the fuel electrode increases from an upstream side to a downstream side of the gas supply flow path, the fuel electrode has a plurality of pores, and a pore diameter of the pores increases from the upstream side to the downstream side of the gas supply flow path.

2. The electrolytic cell according to claim 1, wherein a flow direction of the raw material gas in the gas supply flow path is opposite to a flow direction of the oxygen gas in the gas discharge flow path.

3. The electrolytic cell according to claim 1, wherein the amount of the catalytic material contained in the fuel electrode monotonically increases from the upstream side to the downstream side of the gas supply flow path.

4. The electrolytic cell according to claim 1, wherein the fuel electrode includes a first electrode section and a second electrode section having a larger amount of the catalytic material than the first electrode section, and the first electrode section is disposed upstream of the second electrode section in the gas supply flow path.

5. The electrolytic cell according to claim 1, wherein the fuel electrode has a plurality of pores, and a density of the pores per unit volume increases from the upstream side to the downstream side of the gas supply flow path.

6. The electrolytic cell according to claim 1, wherein an amount of the catalytic material contained in the oxygen electrode is constant from an upstream side to a downstream side of the gas discharge flow path.

7. The electrolytic cell according to claim 1, wherein the fuel electrode is divided into a plurality of electrode sections, each of the plurality of section having a predetermined amount of catalyst contained therein.

* * * * *